United States Patent [19]

Hammer

[11] 4,222,559

[45] Sep. 16, 1980

[54] EXERCISING DEVICE

[76] Inventor: Joseph P. Hammer, 1184 Mackukin, Saint Paul, Minn. 55117

[21] Appl. No.: 957,793

[22] Filed: Nov. 6, 1978

[51] Int. Cl.[3] ..... F16B 12/00; A63B 13/00

[52] U.S. Cl. ..... 272/63; 297/439; 248/188.5; 248/188

[58] Field of Search ..... 272/93, 62, 63, 144; 108/11, 12, 144, 156; 248/188, 188.5, 188.7; 297/439

[56] References Cited

U.S. PATENT DOCUMENTS

| | | | |
|---|---|---|---|
| 775,718 | 11/1904 | Bitter | 272/63 |
| 1,545,527 | 7/1925 | Stevens et al. | |
| 1,610,730 | 12/1926 | Baler | 108/144 |
| 2,666,640 | 1/1954 | Jennings | 272/63 |
| 2,829,705 | 4/1958 | Godshalk | 155/167 |
| 3,114,545 | 12/1963 | Horn | 272/63 |
| 3,659,844 | 5/1972 | Cummins | 272/58 |
| 3,819,176 | 6/1974 | Cummins | 272/63 |

FOREIGN PATENT DOCUMENTS

| | | | |
|---|---|---|---|
| 1370691 | 10/1974 | United Kingdom | 248/188 |

*Primary Examiner*—Richard J. Johnson

*Attorney, Agent, or Firm*—Merchant, Gould, Smith, Edell, Welter & Schmidt

[57] ABSTRACT

An exercising device includes a planar base member having one face finished as a piece of furniture. Two outwardly extending legs are secured to the other face of the base member. The legs include support members which serve as handles when the device is being used as exercising equipment and as feet members when the device is being used as a piece of furniture. The device can be converted between uses simply by inverting the planar base member.

3 Claims, 7 Drawing Figures

EXERCISING DEVICE

TECHNICAL FIELD

This invention relates generally to both the field of exercising devices or equipment and the field of furniture. More particularly, this invention relates to a piece of exercising equipment which is useful both as an exercising device and is convertible to a piece of useful furniture.

BACKGROUND OF THE PRIOR ART

Physical fitness is an important component of a person's over-all health or well-being. It has been scientifically shown that people who are physically fit are less susceptible to heart attacks and certain circulatory ailments. In addition to this decreased chance of sickness or disease, such people are also thought to be better able to cope with the rigors of modern life due to a general feeling of health, increased energy, etc. In accordance with these findings, a large industry has evolved to satisfy the needs of the consuming public for various types of exercising equipment. Although some of this equipment is provided for cardiovascular sports such as jogging or running, a large number of devices are also marketed to help improve skin tone and muscular strength.

Various exercising devices have been developed for use in building muscular strength. Examples of such devices are shown in U.S. Pat. Nos. 775,718 to Bitter and 2,666,640 to Jennings. Bitter discloses an exercising machine which is somewhat similar in function to a set of parallel bars. Jennings discloses a collapsible exercising stand which one can use in doing push-ups, etc. More complex types of stand have also been devised. Such stands are shown in U.S. Pat. Nos. 3,659,844 and 3,819,176 to Cummins. However, these stands include various movable or pivotable rings or tables. Accordingly, these "more complex" stands are more expensive to manufacture and thus obviously more expensive to purchase. This increased expense is a deterrent to use of these stands which use after all is the desirable end goal of all exercising equipment. Thus, in this regard, these stands by discouraging such use are disadvantageous.

One problem with most prior art exercising devices is that they are generally usable only as an exercising device. People who begin an exercising program often do not continue the program at a uniform pace. There may be large amounts of time in which the exercising program is temporarily discontinued. For such people, the exercising device during this time has no value and in fact lays idle. This also discourages use of exercising equipment since some people who would otherwise buy such equipment feel that the cost is still too prohibitive for the limited amount of use which the equipment might receive.

Some exercising devices are also useful for other purposes. For example, U.S. Pat. No. 1,545,527 to Stevens discloses an exercising device which is also convertible into a chair. The Jennings patent noted above discloses that a small table top may be clipped on top of the exercising stand to convert the stand into an occasional table. However, both of these devices involve equipment which to some extent looks like an exercising stand, thereby detracting from its appearance as a piece of furniture. In addition, these devices require that some additional operation or act be performed in converting the equipment. For example, in Stevens, the legs of the chair are pivotable and must be pivotted downwardly when converting the stand into an exerciser. The pivotable legs detract from the appearance of the chair and also require a positive step by the operator to convert the chair into the exerciser. Similarly, the table top of Jennings must be positively clipped onto the exercising stand. In addition, when the table top is not in use, it must be stored in an out of the way location. This discourages use of the Jennings device by people who have a limited amount of storage space or room, such as those who often live in apartments.

SUMMARY OF THE INVENTION

One aspect of this invention is the provision of an exercising device which is also convertible into an ottoman or foot stool. Another aspect of this invention is such a device which is both simple, aethestic, and substantially indistinguishable from a normal piece of furniture when it is used as furniture.

The convertible exercising device of this invention includes a planar base member having one surface configured as a foot stool by means of a resilient cushion or the like. Two legs are secured to the other surface of the base member and extend outwardly therefrom. Each leg comprises a single shaft which terminates in an outwardly curved support member or foot which engages the ground when the exercising device is being used as a foot stool. However, when the exercising device is inverted with the base member being proximate to a floor or other support surface, the support members then also serve as handles which the user of the device can grasp in performing push-ups and the like. The support members have a plurality of positions relative to the base member. This allows the spacing and orientation between the support members to be varied when the support members are being used as handles in performing different exercises.

BRIEF DESCRIPTION OF THE DRAWINGS

This invention will be described hereafter in the Detailed Description when taken in conjunction with the following drawings, in which like reference numerals refer to like elements throughout.

DETAILED DESCRIPTION

Figures 1A, 1B, 2, 3, 4, 5, 6:
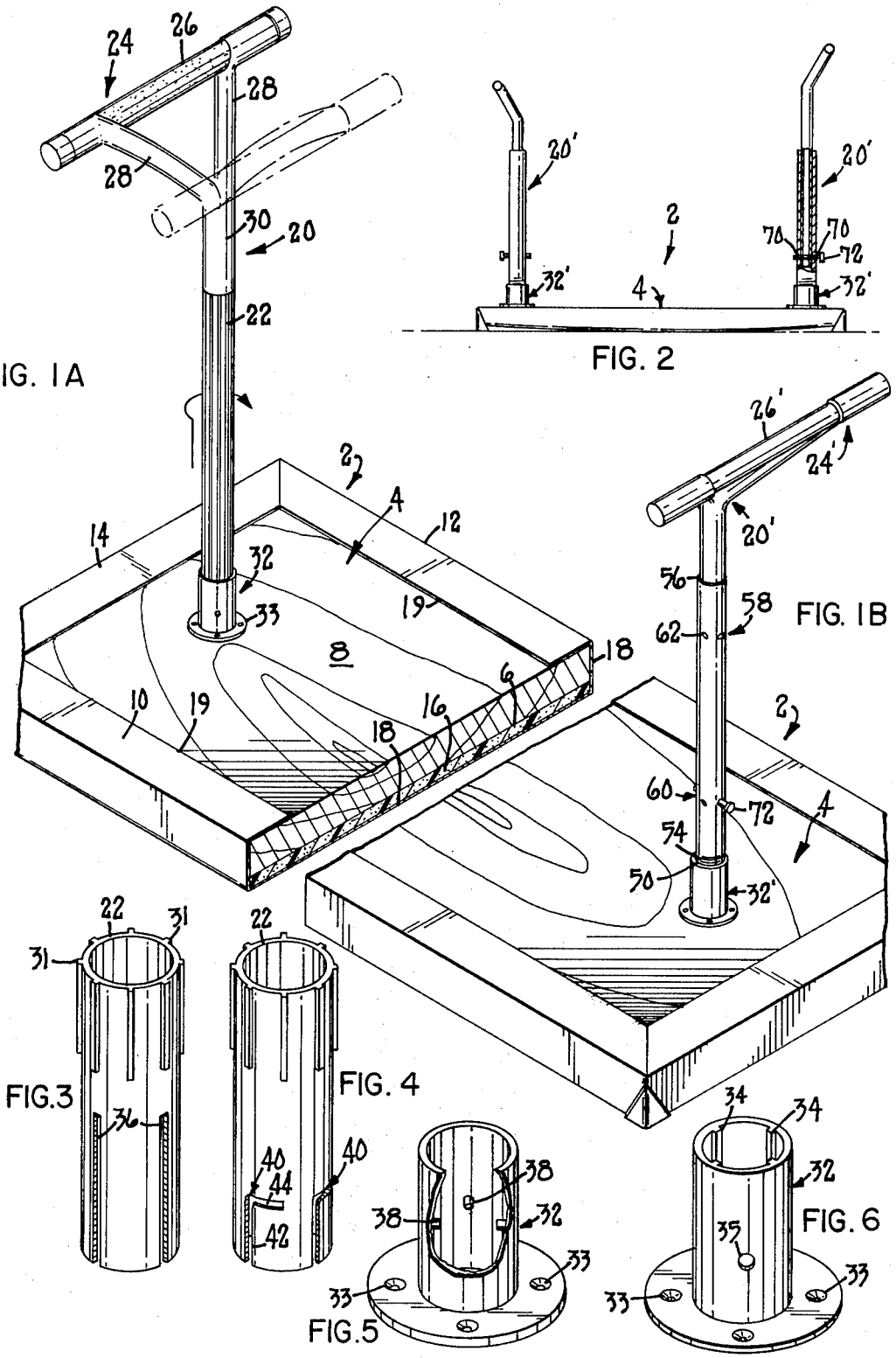
FIG. 1A is a perspective view of one half of an improved exercising device according to this invention, particularly showing the device inverted for use as a piece of exercising equipment and particularly illustrating one embodiment for the leg of the device.
FIG. 1B is a perspective view of one half of an improved exercising device according to this invention, illustrating the exercising device inverted for use as exercising equipment and particularly illustrating a second embodiment for the leg of the device.
FIG. 2 is a side elevational view, partly in cross-section, of an improved exercising device according to this invention, particularly illustrating that embodiment of the legs shown in 1B.
FIG. 3 is a perspective view of the lower end of the leg shown in FIG. 1A, particularly illustrating a first embodiment for a detachable locking means for the leg.
FIG. 4 is a perspective view of the lower end of the leg shown in FIG. 1A, particularly illustrating a second embodiment for a detachable locking means for the leg.
FIG. 5 is a perspective view of one embodiment of a socket used to support the leg of FIG. 1A in conjunction with the locking means of FIG. 3.
FIG. 6 is a perspective view of a second embodiment of a socket used to support the leg of FIG. 1A in conjunction with the locking means of FIG. 4.

Referring to FIG. 1A, an improved apparatus or exercising device according to this invention is generally illustrated as 2. Exercising device 2 comprises a substantially planar base member or support surface 4. Base member 4 has two opposed planar faces 6 and 8. In addition, base member 4 is substantially rectangular having elongated transverse front and back sides 10 and 12 integrally connected by longitudinal sides 14. Only one side 14 is shown in FIG. 1A since only one half of exercising device 2 is shown. Base member 4 may be made of any suitably rigid material. Preferably, base member 4 is made from wood or a similar material.

Exercising device 2 includes a resilient cushion member (e.g., a foam or other suitable material), generally indicated as 16, fixedly applied over the entire face 6 of base member 4. A leather or vinyl facing or covering 18 covers cushion 16 and the exposed edges 10, 12 and 14 of base member 4. Covering 18 may be fixedly secured at 19 along the edges of the other face 8 of base member 4 in any suitable manner (e.g., by adhesives, or staples, etc.). Cushion 16 is of any type such that the face 6 of base member 4 constitutes the upper surface of a piece of furniture. Specifically, exercising device 2 is designed to be convertible into an ottoman or footstool.

Base member 4 is supported above the floor or other support surface when face 6 is uppermost by means of two vertically extending legs, each of which is generally indicated as 20. One embodiment for the legs 20 is illustrated in FIG. 1A. A second embodiment for the legs 20 is illustrated in FIG. 1B. However, on the same exercising device 2, the same embodiment of the leg 20 will be used on each side as base member 4 has two outwardly extending legs 20 located proximately to the longitudinal sides 14.

Referring to FIG. 1A, each leg 20 as shown therein comprises a single upwardly extending shaft, standard or upright 22. An integrally formed support member 24 is located at the other end of shaft 22. Support member 24 includes a longitudinally extending and substantially horizontal handle 26. Two spaced curved rods 28 connect the handle 26 to a vertical sleeve portion 30 which is coaxial with a longitudinal axis through shaft 22. Handle 26 is thus offset by the rods 28 from shaft 22. The rods 28 are separated at the handle 26 by a space which is large enough for the user of the device to insert his hand into in grasping or holding onto the handle 26. Although handle 26 is shown in FIG. 1A in its position on the apparatus 2 when being used as an exercising device, handle 26 forms a foot member for engaging the floor when the apparatus 2 is used as a piece of furniture as explained hereafter. As shown in FIGS. 1A and 3, shaft 22 can have a plurality of spaced vertically extending ribs 31 thereon for decorative purposes.

Each leg 20 is detachably mounted or coupled relative to the base member 4. One embodiment for the detachable coupling means is collectively illustrated in FIGS. 3 and 5. As shown in FIG. 5, the detachable coupling means includes an upwardly extending socket generally indicated as 32. Socket 32 is fixedly mounted on base member 4 by a plurality of securing means (e.g., screws) which extend through holes 33 in a mounting flange on the socket. In addition, socket 32 has four vertically extending longitudinal ribs 34 spaced at 90° around the inner periphery of the socket. Ribs 34 are adapted to be received in four similarly spaced elongated slots 36 (FIG. 3) contained in the lower end of shaft 22. In addition, a locking hole 35 is located in socket 32 between two adjacent ribs 34.

The mounting means shown in FIGS. 3 and 5 allow each leg 20 to be detachably coupled in the socket 32 in any one of four positions which are 90° offset relative to one another. As shown in FIG. 1A, the leg 20 in solid lines is shown in one position. By removing the leg 20 from socket 32 (e.g., by lifting the leg up to disengage slots 36 from ribs 34) and by rotating the leg 180°, the ribs 34 can then be re-engaged in slots 36 as shown in the phantom line position in FIG. 1A. In this position, the handle 26 is located on the inner as opposed to the outer side of shaft 22. A locking pin (not shown) can be inserted through the hole 35 and into the lower end of shaft 22 to lock leg 20 relative to socket 32.

Another embodiment for the detachable locking means is shown in FIGS. 4 and 6. In this embodiment, four locking knobs or lugs 38 extend inwardly from the periphery of socket 32. (See FIG. 6) Lugs 28 are adapted to coact with four L-shaped locking slots 40 in the lower end of the shaft 22. (See FIG. 4) Thus, to couple each leg 20 in the socket 32, the L-shaped locking slots 40 have the vertical portion 42 thereof first aligned with the lugs 38. The shaft 22 is then moved downwardly until the lugs 38 are in alignment with the horizontal portion 44 of each slot 40. Then, the shaft 22 is rotated in a clockwise direction until the lugs 38 are securely located inside the horizontal portion 44. When the legs 20 are locked in the sockets 32 in this manner, there is no possibility that legs 20 will fall out of the sockets 32 during movement or inversion of base member 4. This construction is preferred over that shown in FIGS. 3 and 5 since it is somewhat simpler by doing away with the need for a separate locking hole 36 and pin which pin might be lost by the user of device 2.

In normal use, the device 2 can be used as an ottoman or footstool. When used in this manner, device 2 is inverted from the position shown in FIG. 1A such that base member 4 is supported above the floor by legs 20. In this regard, handles 26 will function as the feet of the device. A user can then sit on cushion 16 or prop his feet thereon.

However, to use the device 2 as a piece of exercising equipment, it is only necessary that the planar base member 4 be inverted and placed in the position shown in FIG. 1A. In this position, the user can easily grab the handles 26 to perform various exercises on the device 2. By virtue of the adjustability of the handles 26 relative to the base member 4, various different exercises can be done. For example, when the handles 26 are in their solid line positions as shown in FIG. 1A, the spacing therebetween is greater than when they are in their reversed dotted line positions due to the offset of the handle from the axis of shaft 22. Thus, the handles 26 in their solid line positions can be used for doing wide exercises such as wide push-ups which are effective in developing the outer pectoral muscles. In the dotted line position, narrow push-ups effective for the inner pectoral muscles can be done. In addition, the handles 26 can also be positioned in sockets 32 until they are colinearly aligned with, or longitudinally offset from, one another and point in a direction 90° offset from the position shown in FIG. 1A (i.e., handles 26 are parallel to sides 10 and 12). Various other exercises are then possible with the handles in this position exercising various other muscle groups (e.g., the triceps).

A second embodiment for the legs 20 is shown in FIGS. 1B and 2 as 20' (prime reference numerals will refer to elements similar to the embodiment shown in FIG. 1A). In this embodiment, socket 32' is fixedly secured to base member 4 by screws or bolts. Socket 32' has a plurality of screw threads 50 on the inner periphery thereof. Leg 20' includes a vertical shaft or upright 22'. The lower end of shaft 22' is threaded as at 54 such that the shaft 22' can be screwed into the socket 32'. Shaft 22' is hollow and has an open upper end 56. In addition, shaft 22' has two sets 58 and 60 of four holes 62 located therein with the holes 62 being spaced around shaft 22' at 90° relative to one another. The hole sets 58 and 60 are vertically spaced on shaft 22'.

Leg 20' further includes a support member 24' carried at the top thereof. Support member 24' is generally similar to support member 24. In other words, an elongated handle 26' is offset from shaft 22' and is connected to a vertical sleeve 30' by two angled or curved rods or tubes 28'. Rods 28' can be welded at one end to sleeve 30' and at the other end to handle 26'. However, vertical sleeve 30' is elongated and extends telescopically down substantially the entire length of hollow shaft 22'. In addition, sleeve 30' has a set of two colinear holes 70 extending therethrough adjacent the lower end of sleeve 30'.

Holes 70 can be respectively aligned with either the first or second sets 58 or 60 of the holes 62. In FIGS. 1B and 2, the holes 70 are shown as being aligned with the lowermost set of holes 60. A cotter pin 72 or any other suitable quickly releasable securing means can then extend through the holes 70 and any two opposed holes 62 which are aligned with the holes 70. Pin 72 releasably locks support member 24' relative to base member 4 and prevents support member 24' from falling out of shaft 22' during inversion of device 2. In addition, support member 24' can still be selectively located in any one of four discrete positions simply by aligning the holes 70 with various pairs or sets of the holes 62. Moreover, the height of the legs 20' can be easily adjusted simply by aligning the holes 70 with either the upper or lower sets 58 and 60 of the holes 62. Thus, with the holes 70 aligned with the upper set of the holes 62, the exercising device 2 can act like a set of parallel bars and allow a form of push-up if the user were to keep his knees above base member 4.

Thus, the apparatus 2 of this invention yields an easily adjustable and useable exercising device. Use of apparatus 2 as an exercising device is encouraged because the apparatus also doubles as an ottoman or footstool when not in use. Moreover, once the legs 20 are positioned in any desired position, the device can be converted between a footstool and an exercising device by the simple act of inverting the planar base member 4. Thus, no complicated operations are required to convert the apparatus from one use to another.

Various modifications of this invention will be apparent to those skilled in the art. For example, the legs 20 and 20' can be made of any suitable material. For example, the shafts 22 and 22' will be made of any suitable metallic materials and may have a highly anodized finish for the sake of appearance. In addition, the detachable mounting means between the sockets 32 and shafts 22 could simply comprise a locking pin through aligned holes in the sockets and shafts (i.e., similar to the pin which goes through locking hole 35 in FIG. 6). Thus, the scope of this invention is to be limited only by the appended claims.

I claim:

1. An improved exercising device, which comprises:

(a) a substantially planar base member suited for resting upon a support surface;

(b) two opposed leg members carried on the base member and extending outwardly therefrom, wherein each leg member comprises a single upright shaft having a longitudinal axis therethrough, and further including a substantially horizontal handle at one end of the shaft distally located from the base member and wherein the handle is offset from the axis of the shaft;

(c) means for detachably and adjustably mounting each of the handles relative to the base member in a discrete number of relatively fixed positions, whereby the orientation of the handles and the spacing therebetween can be varied for different exercises;

(d) wherein the shaft and handle of each leg member are unitary with one another, and wherein the detachable mounting means is located at a lower end of the shaft which is proximate to the base member and located opposite to the end of the shaft which carries the handle;

(e) wherein the base member has two spaced and upwardly extending sockets thereon which are suited for receiving therein the lower ends of the shafts, and wherein the lower end of each shaft has means cooperating with the socket for locking each shaft therein;

(f) wherein each socket has a plurality of spaced inwardly extending locking lugs, and wherein the lower end of each shaft has a plurality of L-shaped locking grooves for releasably receiving the locking lugs to lock the shaft relative thereto; and (g) wherein there are four locking lugs and four locking grooves equally spaced around the peripheries of the socket and the shaft such that each leg can be positioned in any one of four discrete positions.

2. An exercising device as recited in claim 1, in which the legs are attached to one side of the base member, and wherein the other side of the base member is provided with a cushion and outer covering such that the exercising device is convertible into a piece of furniture when inverted from its position as an exercising device.

3. An improved apparatus which is convertible from an exercising device into a, footstool, which comprises:

(a) a substantially planar base member having first and second opposed planar faces, wherein one face of the base member is unbroken in extent and is of sufficient size to allow a person to sit on the one face and also has a resilient cushion thereon enabling that face to act as a cushioned upper surface of the footstool;

(b) two leg members attached to the other face of the base member, wherein the leg members comprise only one vertical shaft terminating in a single substantially horizontal support member and extending outwardly therefrom, wherein the shaft and support member are unitary with one another with the support member being offset from the axis of the shaft;

(c) wherein each support member is elongated to serve as a handle when the other face is located uppermost for use of the apparatus as an exercising device or as a foot member when the apparatus is inverted for use as a footstool with the one face being located uppermost, wherein the support member when used as a foot member is sufficiently long to support the base member stably; and (d) wherein the shaft is adjustably mounted relative to the base member such that each support member can be positioned in any one of a plurality of discrete positions relative to the other support member to vary the orientation and spacing between the support members.

* * * * *